US010358249B1

(12) United States Patent
Wang

(10) Patent No.: US 10,358,249 B1
(45) Date of Patent: Jul. 23, 2019

(54) LABEL POSITIONING MECHANISM

(71) Applicant: CVC TECHNOLOGIES INC., Taichung (TW)

(72) Inventor: Chien-Hsing Wang, Taichung (TW)

( * ) Notice: Subject to any disclaimer, the term of this patent is extended or adjusted under 35 U.S.C. 154(b) by 0 days.

(21) Appl. No.: 16/032,312

(22) Filed: Jul. 11, 2018

(51) Int. Cl.

| | |
|---|---|
| ***B65C 9/06*** | (2006.01) |
| ***B65C 9/02*** | (2006.01) |
| ***B65C 3/08*** | (2006.01) |
| *B65C 9/32* | (2006.01) |
| *B65C 9/34* | (2006.01) |

(52) U.S. Cl.
CPC ..... *B65C 9/067* (2013.01); *B65C 3/08* (2013.01); *B65C 9/02* (2013.01); *B65C 9/32* (2013.01); *B65C 9/34* (2013.01)

(58) Field of Classification Search
CPC ..... B65C 9/067; B65C 9/34
USPC ..... 198/626.6
See application file for complete search history.

(56) References Cited

U.S. PATENT DOCUMENTS 9,981,766 B2 * 5/2018 Harte ..... B65C 9/32
10,081,450 B2 * 9/2018 Merrill ..... B65C 3/16

* cited by examiner

*Primary Examiner* — Gene O Crawford
*Assistant Examiner* — Lester Ill Rushin

(57) ABSTRACT

A label positioning mechanism has a conveying mechanism, a label dispensing mechanism disposed on a side of the conveying mechanism, a first labeling mechanism disposed together with the label dispensing mechanism on the same side of the conveying mechanism and positioned proximate to the label dispensing side, and a second labeling mechanism which is disposed on another side of the conveying mechanism and opposes the first labeling mechanism. A first tight-fitting winding belt of the first labeling mechanism and a second tight-fitting winding belt of the second labeling mechanism move in opposite transmission directions and come into contact with each other to rotate bottles. Therefore, the label positioning mechanism is capable of rotating labeled bottles by a specific angle by adjusting the speeds of the conveying mechanism, the first tight-fitting winding belt, and the second tight-fitting winding belt so as to render ensuing processes speedy.

5 Claims, 2 Drawing Sheets

LABEL POSITIONING MECHANISM

FIELD OF THE INVENTION

The present disclosure relates to label positioning mechanisms and, more particularly, to a label positioning mechanism capable of rotating labeled bottles by a specific angle by adjusting the speed of a conveying mechanism, the speed of a first tight-fitting winding belt, and the speed of a second tight-fitting winding belt so as to render ensuing processes speedy.

BACKGROUND OF THE INVENTION

A conventional bottle-rolling label positioning mechanism entails conveying bottles with a conveyor belt and moving the bottles with a reeling belt operating in conjunction with a panel so as to stick labels to bodies of the bottles.

To improve productivity of the aforesaid labelling process, it is feasible to increase the transmission speed of the conveyor belt and the reeling belt. Sticking labels to bottles rotating at a high speed and moving at a high speed leads to a phenomenon—the labeled bottles halt but with their respective labels facing different directions under a centrifugal force. However, the phenomenon is undesirable, as it is impossible to perform a testing process on the labeled bottles with their respective labels facing different directions. In an attempt to cope with the aforesaid undesirable phenomenon, an alignment inspection mechanism is used, albeit useless for improving productivity of the aforesaid labelling process.

Therefore, it is imperative to provide a label positioning mechanism capable of rotating labeled bottles by a specific angle by adjusting the speed of a conveying mechanism, the speed of a first tight-fitting winding belt, and the speed of a second tight-fitting winding belt so as to render ensuing processes speedy.

SUMMARY OF THE INVENTION

In view of the aforesaid drawbacks of the prior art, it is an objective of the present disclosure to provide a label positioning mechanism conducive to bottle labeling and capable of rotating labeled bottles by a specific angle by adjusting the speed of a conveying mechanism, the speed of a first tight-fitting winding belt, and the speed of a second tight-fitting winding belt so as to render ensuing processes speedy.

In order to achieve the above and other objectives, the present disclosure provides a label positioning mechanism comprising a conveying mechanism, a label dispensing mechanism, a first labeling mechanism, and a second labeling mechanism. The conveying mechanism conveys a plurality of bottles in a conveying direction. The label dispensing mechanism is disposed on a side of the conveying mechanism. The label dispensing mechanism has a label dispensing side for outputting a plurality of labels in the conveying direction. The first labeling mechanism is disposed together with the label dispensing mechanism on the same side of the conveying mechanism and positioned proximate to the label dispensing side. The first labeling mechanism has a first tight-fitting winding belt. The first tight-fitting winding belt has a transmission direction parallel to the conveying direction, and the transmission direction faces a side of the conveying mechanism. The second labeling mechanism is disposed on the other side of the conveying mechanism, opposes the first labeling mechanism, and has a second tight-fitting winding belt. The second tight-fitting winding belt has a transmission direction opposite to the conveying direction, and the transmission direction faces a side of the conveying mechanism. The first tight-fitting winding belt and the second tight-fitting winding belt come into contact with each other to rotate the bottles. The conveying speed of the conveying mechanism, dispensing speed of the label dispensing mechanism, transmission speed of the first tight-fitting winding belt and transmission speed of the second tight-fitting winding belt are adjustable according to a diameter of the bottles and a specific angle of rotation of the bottles.

The difference between the transmission speed of the first tight-fitting winding belt and the transmission speed of the second tight-fitting winding belt is adjustable according to the diameter of the bottles and the specific angle of rotation of the bottles.

The conveying mechanism has a conveyor belt. The conveyor belt conveys the bottles in the conveying direction.

The first labeling mechanism has a first base and a first driving unit. The first driving unit is disposed on the first base. The first tight-fitting winding belt is wound around the first base and transmitted by the first driving unit.

The first base further has a first adjustment unit. The first adjustment unit adjusts the height of the first base relative to the conveying mechanism.

The second labeling mechanism has a second base and a second driving unit. The second driving unit is disposed on the second base. The second tight-fitting winding belt is wound around the second base and transmitted by the second driving unit.

The second base further has a second adjustment unit and a third adjustment unit. The second adjustment unit adjusts the height of the second base relative to the conveying mechanism. The third adjustment unit adjusts the distance between the second base and the first base.

The first tight-fitting winding belt of the first labeling mechanism and the second tight-fitting winding belt of the second labeling mechanism move in opposite transmission directions and come into contact with each other to rotate bottles. Therefore, the label positioning mechanism is capable of rotating labeled bottles by a specific angle by adjusting the speeds of the conveying mechanism, the first tight-fitting winding belt, and the second tight-fitting winding belt so as to render ensuing processes speedy.

DETAILED DESCRIPTION OF THE PREFERRED EMBODIMENTS

Objectives, features, and advantages of the present disclosure are hereunder illustrated with specific embodiments, depicted by the accompanying drawings, and described below.

Figure 1:
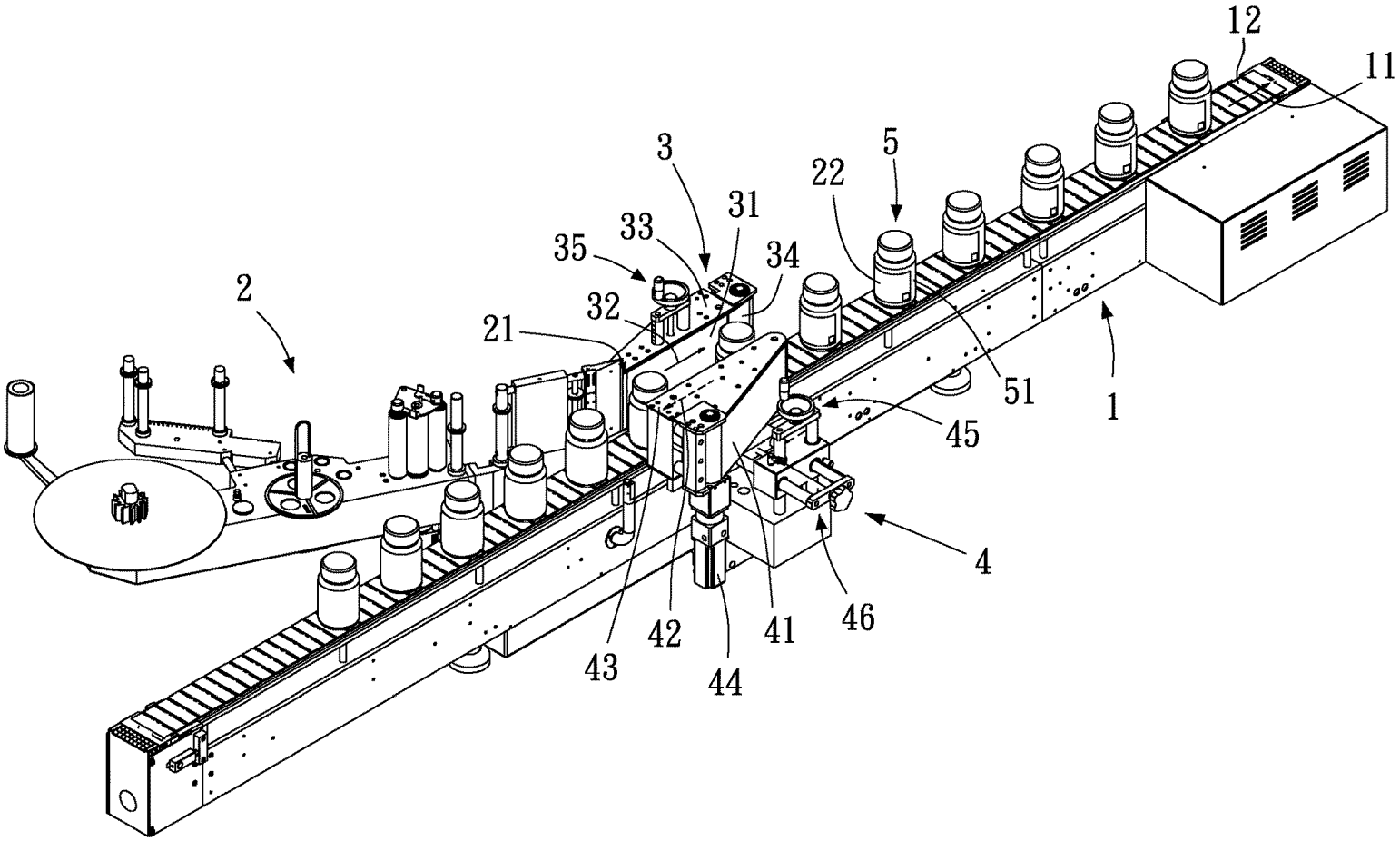
FIG. 1 is a perspective view of a label positioning mechanism according to a specific embodiment of the present disclosure.
Figure 2:
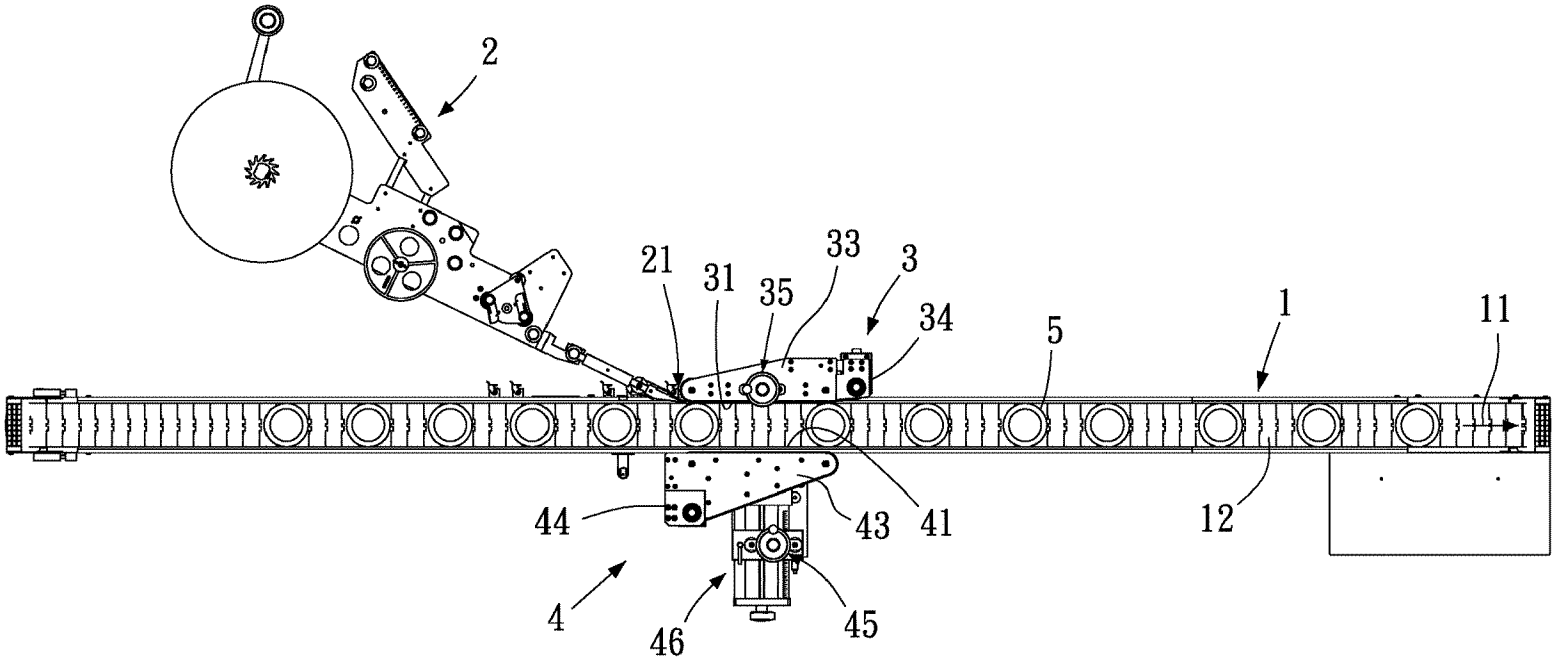
FIG. 2 is a top view of the label positioning mechanism according to a specific embodiment of the present disclosure.

Referring to FIG. 1 and FIG. 2, the present disclosure provides a label positioning mechanism. The label positioning mechanism comprises a conveying mechanism 1, a label dispensing mechanism 2, a first labeling mechanism 3, and a second labeling mechanism 4. In an embodiment of the present disclosure, the label positioning mechanism positions labeled bottles in such a manner that their respective labels face a specific direction.

The conveying mechanism 1 conveys a plurality of bottles 5 in a conveying direction 11.

The label dispensing mechanism 2 is disposed on one side of the conveying mechanism 1. The label dispensing mechanism 2 has a label dispensing side 21 for outputting a plurality of label 22 in the conveying direction 11.

The first labeling mechanism 3 is disposed together with the label dispensing mechanism 2 on the same side of the conveying mechanism 1 and positioned proximate to the label dispensing side 21 of the label dispensing mechanism 2. The first labeling mechanism 3 has a first tight-fitting winding belt 31. The first tight-fitting winding belt 31 has a transmission direction 32 parallel to the conveying direction 11. The transmission direction 32 faces a side of the conveying mechanism 1.

The second labeling mechanism 4 is disposed on the other side of the conveying mechanism 1 and opposes the first labeling mechanism 3. The second labeling mechanism 4 has a second tight-fitting winding belt 41. The second tight-fitting winding belt 41 has a transmission direction 42 opposite to the conveying direction 11. The transmission direction 42 faces a side of the conveying mechanism 1. The first tight-fitting winding belt 31 and the second tight-fitting winding belt 41 come into contact with each other to rotate the bottles 5.

In an embodiment of the present disclosure, operation of the label positioning mechanism entails placing the bottles 5 on a conveyor belt 12 of the conveying mechanism 1 and moving the conveying mechanism 1, the label dispensing mechanism 2, the first labeling mechanism 3, and the second labeling mechanism 4 simultaneously. The conveyor belt 12 of the conveying mechanism 1 conveys the bottles 5 in the conveying direction 21. As soon as one said bottle 5 is conveyed to the label dispensing side 21 of the label dispensing mechanism 2, the label dispensing side 21 outputs a label 22 in the conveying direction 11, so as to stick the label 22 to a body 51 of the bottle 5. Then, the first tight-fitting winding belt 31 and the second tight-fitting winding belt 41 come into contact with each other to rotate the bottle 5. Furthermore, the label 22 is stuck to the body 51 of the bottle 5, because of the transmission of the first tight-fitting winding belt 31 and the second tight-fitting winding belt 41 and the rotation of the bottle 5.

The transmission direction 32 of the first tight-fitting winding belt 31 of the first labeling mechanism 3 faces one side of the conveying mechanism 1 and is parallel to the conveying direction 11. The transmission direction 42 of the second tight-fitting winding belt 41 of the second labeling mechanism 4 faces one side of the conveying mechanism 1 and is opposite to the conveying direction 11. Therefore, in an embodiment of the present disclosure, the label positioning mechanism is capable of rotating the bottle 5 which the label 22 is stuck to by a specific angle and thus rendering ensuing processes speedy, by adjusting the speed of the conveying mechanism 1, the speed of the label dispensing mechanism 2, the speed of the first tight-fitting winding belt 31 of the first labeling mechanism 3, and the speed of the second tight-fitting winding belt 41 of the second labeling mechanism 4. The conveying speed of the conveying mechanism 1, the dispensing speed of the label dispensing mechanism 2, the transmission speed of the first tight-fitting winding belt 31, and the transmission speed of the second tight-fitting winding belt 41 are adjustable as needed, according to the diameter of the bottles 5 and the desirable specific angle of rotation of the bottles 5. The difference between the transmission speed of the first tight-fitting winding belt and the transmission speed of the second tight-fitting winding belt is adjustable according to the diameter of the bottles 5 and the desirable specific angle of rotation of the bottles 5.

In a specific embodiment of the present disclosure, the conveying mechanism 1 has the conveyor belt 12. The conveyor belt 12 conveys the bottles 5 in the conveying direction 11.

In a specific embodiment of the present disclosure, the first labeling mechanism 3 has a first base 33 and a first driving unit 34 (such as a motor-driven roller). The first driving unit 34 is disposed on the first base 33. The first tight-fitting winding belt 31 is wound around the first base 33 and transmitted by the first driving unit 34. The second labeling mechanism 4 has a second base 43 and a second driving unit 44 (such as a motor-driven roller). The second driving unit 44 is disposed on the second base 43. The second tight-fitting winding belt 41 is wound around the second base 43 and transmitted by the second driving unit 44. Therefore, the first driving unit 34 is capable of transmitting the first tight-fitting winding belt 31, and the second driving unit 44 is capable of transmitting the second tight-fitting winding belt 41. Therefore, the label positioning mechanism is capable of rotating the bottle 5 which the label 22 is stuck to by a specific angle and thus rendering ensuing processes speedy, by adjusting the speeds of the conveyor belt 12, the label dispensing mechanism 2, the first tight-fitting winding belt 31 and the second tight-fitting winding belt 41.

In a specific embodiment of the present disclosure, the first base 33 further has a first adjustment unit 35 (such as a manually-operable screw). The first adjustment unit 35 adjusts the height of the first base 33 relative to the conveying mechanism 1. The second base 43 further has a second adjustment unit 45 (such as a manually-operable screw) and a third adjustment unit 46 (such as a manually-operable screw). The second adjustment unit 45 adjusts the height of the second base 43 relative to the conveying mechanism 1. The third adjustment unit 46 adjusts the distance between the second base 43 and the first base 33. Therefore, the first adjustment unit 35 and the second adjustment unit 45 adjust the heights of the first base 33 and the second base 43 according to the height of the bottles 5 such that the first base 33 and the second base 43 match the bottles 5 in terms of height. Furthermore, the third adjustment unit 46 adjusts the distance between the second base 43 and the first base 33 according to the diameter of the bottles 5 such that the first base 33 matches the second base 43 and thus matches the bottles 5 in terms of the diameter thereof, thereby fitting the bottles 5 of different sizes.

The present disclosure is disclosed above by preferred embodiments. However, persons skilled in the art should understand that the preferred embodiments are illustrative of the present disclosure only, but shall not be interpreted as restrictive of the scope of the present disclosure. Hence, all equivalent modifications and replacements made to the aforesaid embodiments shall fall within the scope of the present disclosure. Accordingly, the legal protection for the present disclosure shall be defined by the appended claims.

What is claimed is:

1. A label positioning mechanism, comprising:

a conveying mechanism for conveying a plurality of bottles in a conveying direction;

a label dispensing mechanism disposed on a side of the conveying mechanism and having a label dispensing side for outputting a plurality of labels in the conveying direction;

a first labeling mechanism disposed together with the label dispensing mechanism on the same side of the conveying mechanism and positioned proximate to the label dispensing side, wherein the first labeling mechanism has a first tight-fitting winding belt and a first base for winding the first tight-fitting winding belt, the first tight-fitting winding belt having a transmission direction parallel to the conveying direction, the transmission direction facing a side of the conveying mechanism; and a second labeling mechanism disposed on another side of the conveying mechanism, opposing the first labeling mechanism, and having:

a second tight-fitting winding belt having a transmission direction opposite to the conveying direction, the transmission direction facing a side of the conveying mechanism, wherein the first tight-fitting winding belt and the second tight-fitting winding belt come into contact with each other to rotate the bottles;

a second base for winding the second tight-fitting winding belt;

a second driving unit located on the second base and operatable to transmit the second tight-fitting winding belt;

a second adjustment unit for adjusting a height of the second base relative to the conveying mechanism; and a third adjustment unit for adjusting a distance between the first and second bases;

wherein a conveying speed of the conveying mechanism, a dispensing speed of the label dispensing mechanism, a transmission speed of the first tight-fitting winding belt, and a transmission speed of the second tight-fitting winding belt are adjustable according to a diameter of the bottles and a specific angle of rotation of the bottles.

2. The label positioning mechanism of claim 1, wherein a difference between the transmission speed of the first tight-fitting winding belt and the transmission speed of the second tight-fitting winding belt is adjustable according to the diameter of the bottles and the specific angle of rotation of the bottles.

3. The label positioning mechanism of claim 1, wherein the conveying mechanism has a conveyor belt for conveying the bottles in the conveying direction.

4. The label positioning mechanism of claim 1, wherein the first labeling mechanism has a first driving unit disposed on the first base such that the first tight-fitting winding belt is transmitted by the first driving unit.

5. The label positioning mechanism of claim 4, wherein the first base further has a first adjustment unit for adjusting a height of the first base relative to the conveying mechanism.

* * * * *